United States Patent [19]

Wood et al.

[11] Patent Number: 4,694,899

[45] Date of Patent: Sep. 22, 1987

[54] EDGE DAM SYNCHRONIZATION AND TENSIONING CONTROL METHOD AND SYSTEM FOR THE SHAPING AND PROFILING OF CONTINUOUSLY CAST METAL SECTIONS BY MEANS OF A CONTINUOUS CASTING MACHINE

[75] Inventors: John F. B. Wood, Burlington; Timothy D. Kaiser; Jerome B. Allyn, both of Colchester; Charles D. Dykes, Milton; Frank E. Kalaskie; Robert J. Carmichael, both of Colchester; Charles R. Simon, Williston, all of Vt.

[73] Assignee: Hazelett Strip-Casting Corporation, Colchester, Vt.

[21] Appl. No.: 937,319

[22] Filed: Dec. 3, 1986

[51] Int. Cl.[4] ..... B22D 11/06; B22D 11/16

[52] U.S. Cl. ..... 164/452; 164/431; 164/481

[58] Field of Search ..... 164/431, 432, 481, 154, 164/452

[56] References Cited

U.S. PATENT DOCUMENTS 4,150,711 4/1979 Hazelett et al. ..... 164/431 X

FOREIGN PATENT DOCUMENTS 59-189043 10/1984 Japan ..... 164/431

*Primary Examiner*—Kuang Y. Lin

*Attorney, Agent, or Firm*—Parmelee, Bollinger & Bramblett

[57] ABSTRACT

A method and system are provided for synchronizing the travelling edge dams in the continuous casting of metal slab, strip, or bar, thereby providing a means for the continuous uniform casting of longitudinally spaced edge shapes, contours, or profiles such as integral shoulders, lugs, lobes, depressions, curves, or indentations in the opposite edges of the cast product. Shapes include the protruding lugs, cast directly opposite each other, for suspending copper anodes in electrolytic refining-also the intruding, material-saving contours in the tops of anodes. A belt-type continuous casting machine is shown wherein two moving contoured edge dam loops each comprise blocks strung upon flexible endless metal straps. The moving edge dams on each side of the mold must be synchronized, regardless of disturbing thermal variations notably. "Back breakers" exert upward rolling contact force controllably and separately against each moving edge dam loop along its return path, thereby changing the local curvature and so adjusting the degree of mutual compression and closeness of the constituent dam blocks or the end-to-end spacing of the same. Such compression effectively shortens the elevated edge dam loop and thereby hastens its revolutions. Known previous methods of heating or cooling to synchronize the edge dam loops may advantageously be used in addition to back-breaker control. The positioning of separate "back-breaker" apparatus in an inverted configuration near the entrance to the moving mold results in a significant improvement in the sealing capability of the entering edge dams against the lower casting belt where molten metal is introduced.

20 Claims, 20 Drawing Figures

U
L
230
255
256
312
268
207
200
201
315
318
202
214
74
48
44
22
24
M
43
47
214A
30
304
E
232
300
320
313
270
269
271
319
317
115
116
302
253
254
114

(PRIOR ART)
FIG. 7A
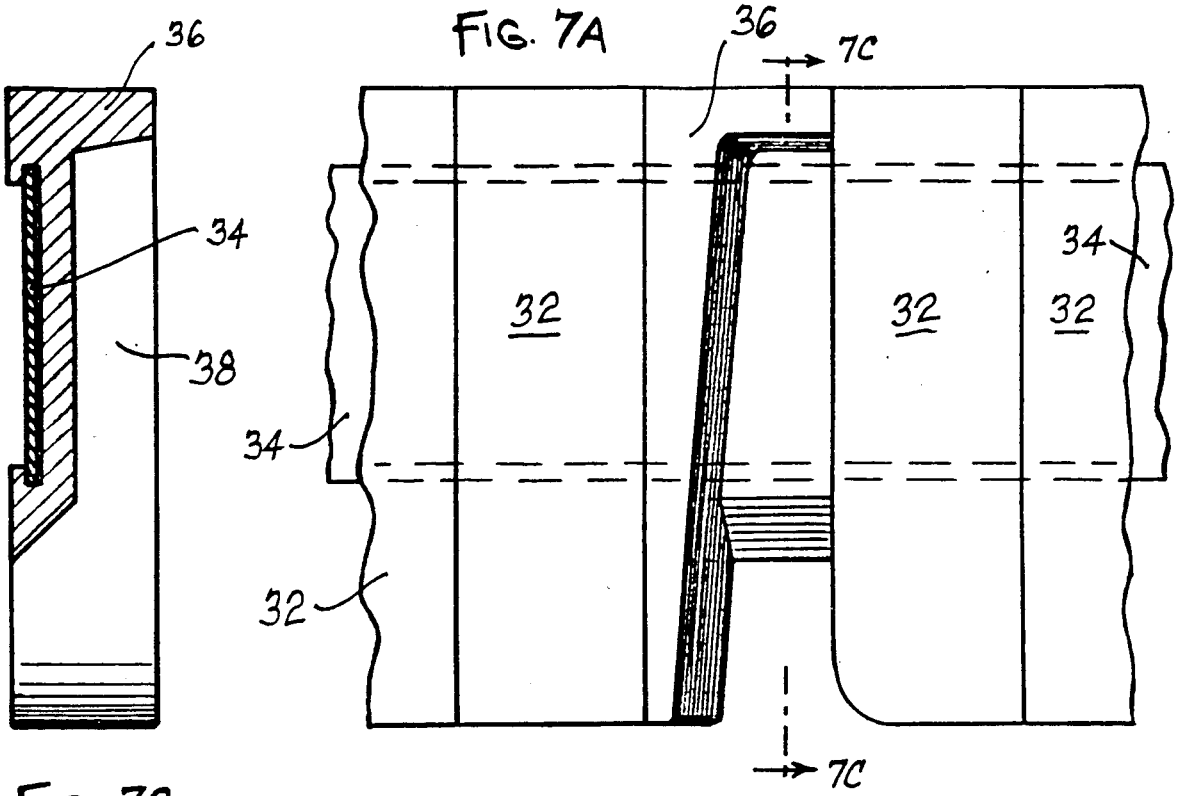
FIG. 7C
(PRIOR ART)
(PRIOR ART)
FIG. 7B
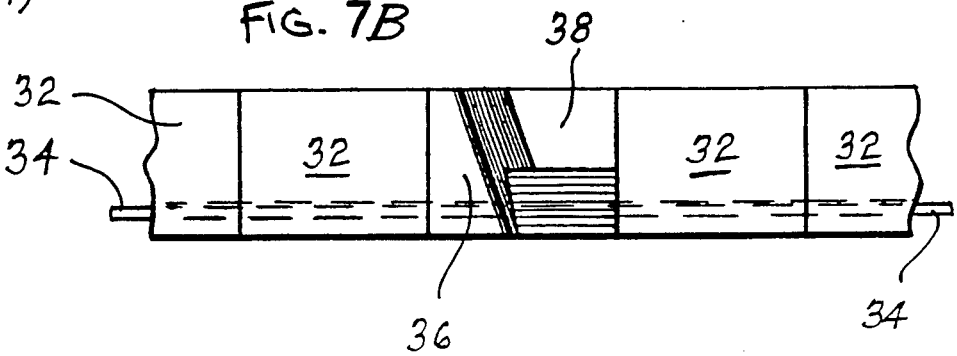

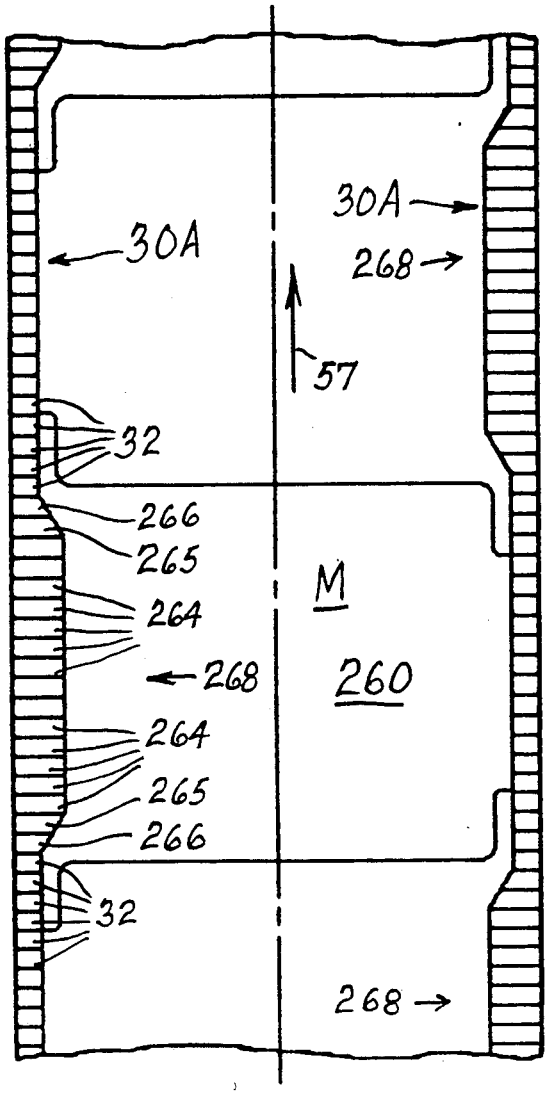
FIG. 9
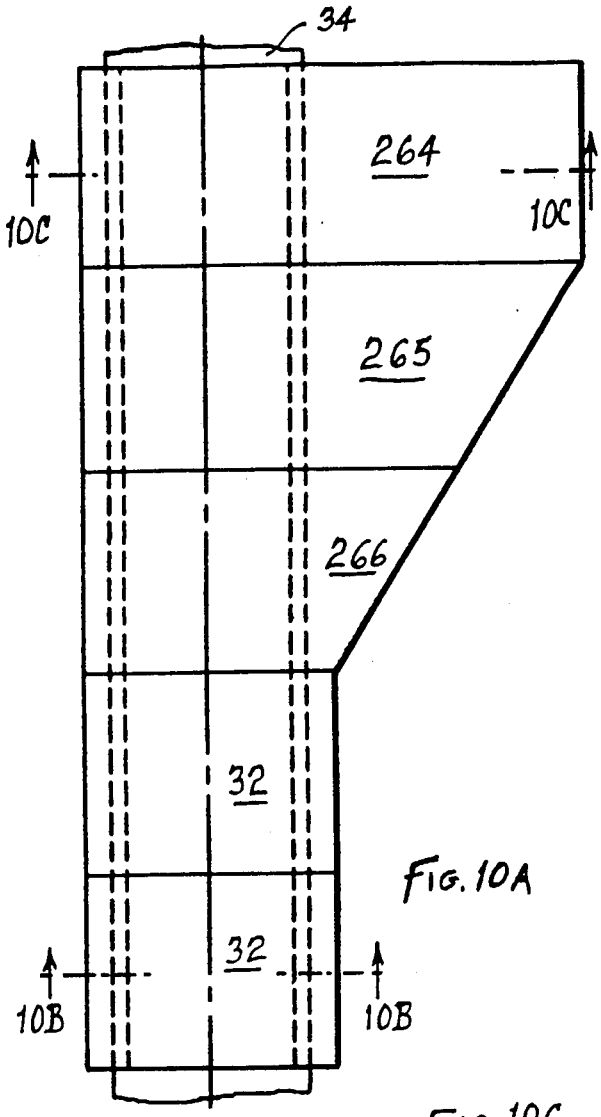
FIG. 10A
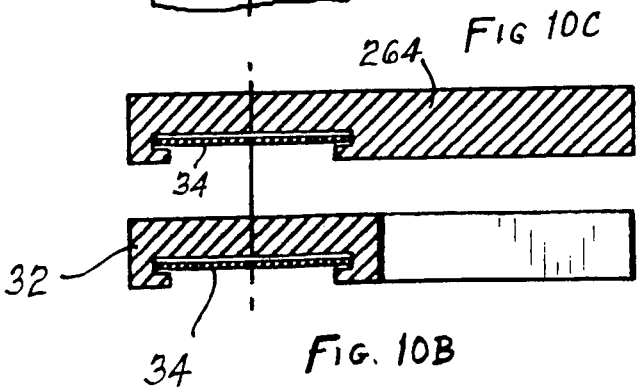
FIG 10C
FIG. 10B

FIG. 13
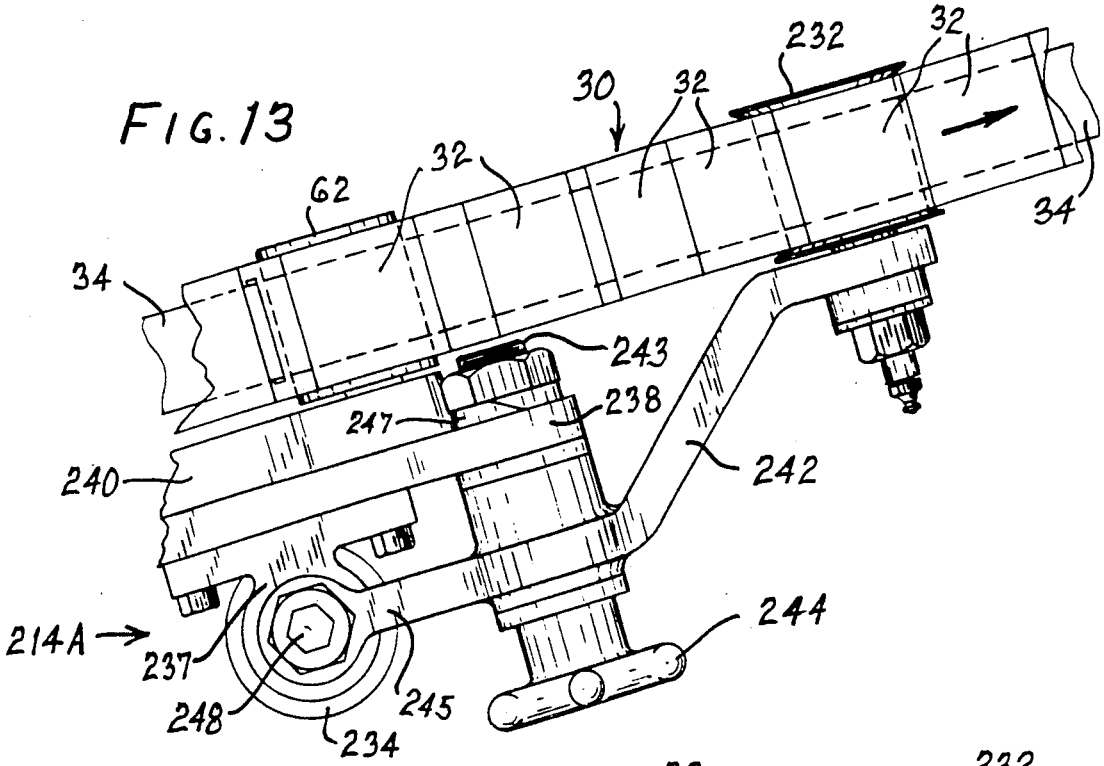
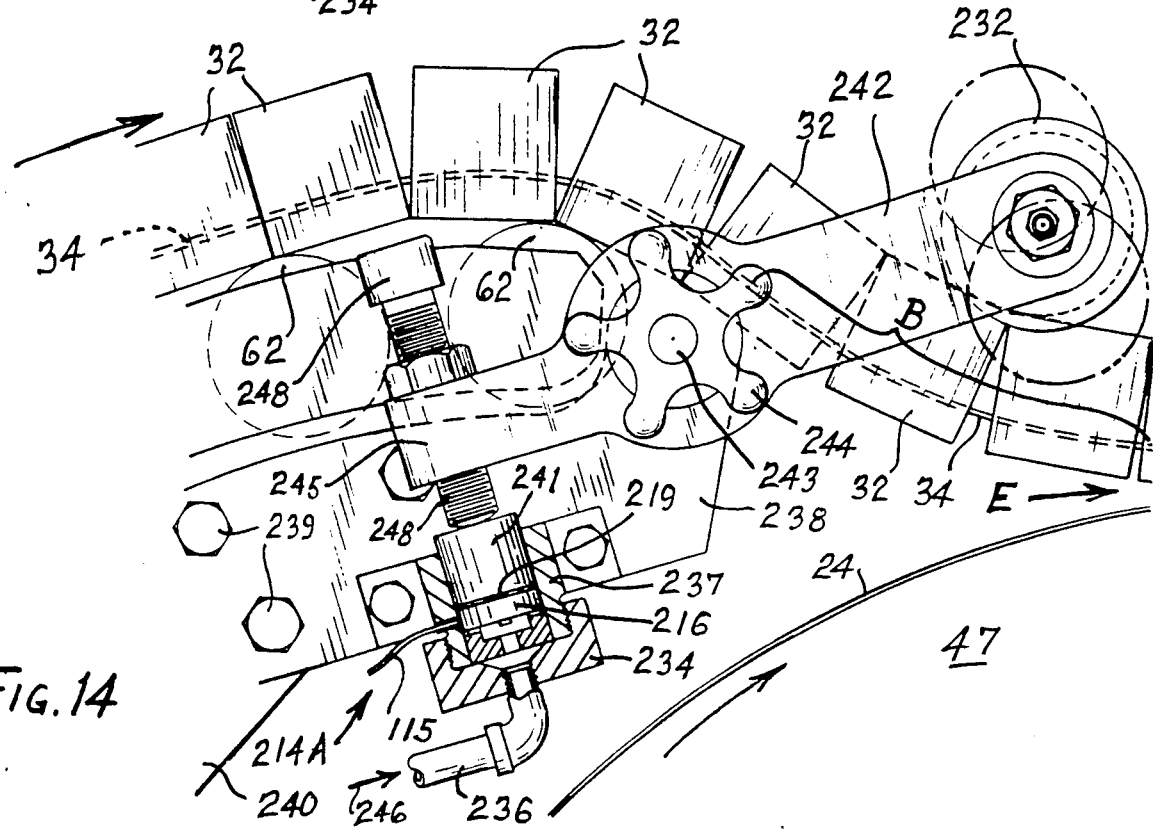
FIG. 14

EDGE DAM SYNCHRONIZATION AND TENSIONING CONTROL METHOD AND SYSTEM FOR THE SHAPING AND PROFILING OF CONTINUOUSLY CAST METAL SECTIONS BY MEANS OF A CONTINUOUS CASTING MACHINE

BACKGROUND

U.S. Pat. No. 4,150,711, is entitled "Method and Apparatus for Continuously Casting Metal Slab, Strip or Bar with Partial Thickness Integral Lugs Projecting Therefrom" (R. W. Hazelett and J. F. B. Wood). It is assigned to the same assignee as the present application and is Incorporated herein by reference. The continuous casting machine described therein by reference. The continuous casting machine described therein employs two revolving edge dam strings, the blocks of which are strung in closed loops disposed opposite each other in parallel, the blocks being strung upon longitudinal high-strength unifying members there shown as straps. The edge dam blocks include special blocks having partial thickness mold pockets for forming integral, cast-in protruding shoulders or lugs on the cast product. In one existing installation, there are nine such special dam blocks uniformly spaced around each edge-dam loop. By the term "block" in reference to the elements of edge dams, we mean to include not only rectangular shapes but other shapes such as the special blocks just mentioned and trapezoidal shapes.

The cast product issuing from the continuous casting machine may be cut by means of a shear or torch into anodes for the electrolytic refining of copper. Presently, for example, each anode is on the order of 36 inches (900 mm) long. The pair of edge dams is synchronized and controlled through a feedback loop to maintain the profile or shape of the product being continuously cast. The cast-in protruding shoulders or lugs serve as hangers or supports for each anode and provide electrical connections for the anode as it hangs its shoulders in the electrolytic tank. The anode thus formed may be so profiled as to minimize scrap. The protruding shapes so cast may be the full thickness of the cast product generally, or they may be some fraction of the thickness, or some combination of the two. But for the use of such projections or lugs in the casting of anodes, the lugs should normally be in directly opposed, square, accurate alignment on the opposed parallel sides of the cast product. In this way, the resultant anodes can be closely and accurately suspended by means of these cast-in hangers or supports in the electrolytic solution of a tankhouse without touching the sides of the tank. This control of alignment can be done in such a uniform way as to avoid electrical arcing of short circuits commonly caused by imprecise alignment and contact between anodes. In order for the lugs or integral supporting shoulders to be formed in the usually desired mutually square alingment, or in any other consistent alignment synchronization of the movements of the edge dams traveling along the opposed edges of a moving mold must be controlled and maintained. Without such synchronization control, random factors such as temperature variations will cause initially synchronized edge dams to drift or diverge in their alignment relative to each other; one edge dam may then be said to "walk away" from the other.

The same requirements and considerations are applicable when the edge dams are utilized for a different prupose, that is, not to cast spaced lugs, but for example to cast spaced lobes or recessed hollows for purposes hereinafter described.

The need for edge-dam synchronization arises from perhaps five sources of cumulating offset or error in the relative positions of the mold pockets in the two moving edge dams which serve to cast the lugs. Three of these error sources involve the effects of varying amounts of heat transfer at the edges of the moving mold, causing differential thermal expansion of the respective edge dams, and the other two involve the effective lengths of the blocks and their end-to-end spacing:

First, one edge dam may heat up more than the other because of the flow of the incoming molten metal being inadvertently directed more toward one than the other entering edge dam.

Second, unpredictable variation arises mainly from the effects of interstitial air gaps or interstices of varying thickness occurring between the product being cast and the respective blocks of the edge dams, across which gaps heat from the solidifying molten metal is extracted. Such air gaps result in part from varying local shrinkages of the product, or variations in pressure exerted upon the edge dams by mechanical constraints--for example, by the side guides external to the dams as well as the belts, all of which extract from the dams. Air gaps may also result from imperfect squareness or wear of the downstream in-line pinch roll stand, which engages the cast product soon after issuing from the moving mold (downstream being defined as the direction of metal product flow). Such out-of-squareness about a vertical axis will drag the emerging product slightly sideways, thus pressing it harder against the dam blocks of one edge dam. The pinch rolls grip the frozen product soon after it emerges from the casting machine and mechanically insulate the operation of the casting machine from the effects of subsequent equipment such as a rolling mill or cutoff shear. The pinch rolls are carefully synchronized with the casting machine though they are normally driven at a slightly slower, carefully adjusted speed, in order to maintain the cast product in a state of compression until it is cooled below the range of hot-shortness.

A third source of variable heat transfer, likewise unpredictable, arises from films of oxide, etc., of varying thicknesses upon both the edge dams and on the nearby regions of the product, again causing variations in heat flow from the metal being cast into the dam blocks and consequently causing variations in the heating of these blocks.

A fourth general source of cumulative error can arise from variations in the original, as-manufactured length of the dam blocks, in the longitudinal direction of their movement. Tolerances in the length of each of the many individual dam blocks cumulate into significant error in the length of a whole dam loop. Normally, a tolerance of around $\pm 0.001$ inch (25 micrometers) is maintained in the manufacture of the blocks. However, the last block to be assembled into an edge-dam loop can be specially machined to a length that compensates for cumulative error of length in block manufacture.

Fifth, foreign matter such as oxide scale from heat, or mineral deposits from evaporated cooling water, may find its way between the dam blocks, thereby changing their end-to-end spacing or effective lengths.

The foregoing factors combine to render powerful means of synchronization fully necessary--preferably automatic in order to achieve high levels of uninterrupted production of high quality cast product.

Synchronization is achieved in the method and apparatus described in the aforesaid patent by sensing the relative errors in position of the laterally extending depressions in the traveling edge dams or by sensing the cast lugs after they exit from the casting machine. The temperatures of the revolving edge dams are then controllaby changed with respect to each other. This change in relative temperature is accomplished by increasing the heating or cooling of at least one of the pair of revolving edge dams when it tends to lag the other, thereby alterning its loop length and thus altering its rate of completing its revolutions. If an edge dam is cooled and thereby shortened, it completes its revolutions faster and so tends to gain in position. If an edge dam is heated, the opposite occurs.

U.S. Pat. No. 4,586,559 for "Process and Apparatus for Casting a Strip with Laterally Extending Lugs" (M. K. Govaerts, H. A. L. Gielen and J. M. A. Dompas) is assigned to the same assignee as the present application and is incorporated herein by reference. In that patent application, strings of edge-dam blocks are described as being deliberately heated as by means of radiant gas burners, or cooled by means of aqueous sprays, with the object of synchronizing the progress or cycling of the edge dams. Both heating and cooling may be employed in conjunction with each other in order to enhance the effectiveness of synchronization of the traveling edge dams.

The heating and cooling may be carried on automatically in a "closed-loop" control in order to free an operator from the task of manual alignment control, thereby enabling the use of the operator's time elsewhere on the continuous casting line. However, it has been found that heating and/or cooling within acceptable limits of temperature may not always be powerful enough to maintain synchronization of the traveling edge dams, i.e., not powerful enough to prevent the desired "closed-loop" mode of control from inadvertently turning into an unstable "open-loop" whereby one edge dam progressively "walks away" from its desired location with respect to the other in a situation of progressively increasing errir between the lug positions on opposite edges of the cast product. The reslt is the casting of irregularly formed anodes which cannot be suspended inthe electrolytic tanks of the tank-house.

During any kind of continuous casting, whether of anodes or of other products, there have at times occurred sizeable open gaps between successive edge-dam blocks. These gaps or spacings result from contingencies in the manufacture, use, and wear of the assembled edge dams. These open gap between edge-dam blocks must be closed in order to complete the mold; i.e., molten metal must be prevented from flowing or "flashing" and wedging into spaced between successive dam blocks and then freezing into troublesome fins which are apt to cause interruptions in casting. In extreme cases, fins can cause leaks which are especially dangerous in the casting of steel, since steel with its normally molten oxides displays a low surface tension--rather like that of water.

U.S. Pat. Nos. 3,865,176 and 3,955,615 are assigned to the same assignee as the present application and are incorporated herein by reference. As therein described, gaps occurring between successive edge-dam blocks are cloased into a relation of mutual closeness in the mold by causing each edge dam, while in use, to follow a path such that its own geometry causes many of the edge dam blocks to press endwise together while strung upon the high strength longitudinal unifying member shown as a metal strap. More specifically, each edge dam in its return path back to the moving mold is made to pass, after exit from the mold, over a roller tensing apparatus with the rollers disposed so as to conform approximately to a smooth curve. The roller tensing apparatus are commonly known as "back-breakers." Each is usually assembled and configured into a system with a movable cooling chamber which incorporates a cooling apparatus, together with sensors and automatic controls and actuators. Back-breakrs are so mounted so as to be controllably forced or lifted up against the edge dam loop. When moved upwardly, the back breaker causes the edge dam so deflected to travel locally along a smoothly curved arc which is concave as seen from the exterior of the edge dam loop. Any slack or open gaps between the dam blocks in the moving mold are taken up by the geometrical effect of this local concavity along the return path of the edge dam. Specifically, the geometrical effect is that of causing wedge-shaped spaced to occur between the dam blocks along the arc of this local concavity in such a manner as to cause such block effectively to occupy more space along its strap (see FIG. 3 of U.S. Pat. No. 3,865,176), thereby compacting or pressing together the remainder of the blocks in the edge-dam as a whole along each whole string or loop, which string or loop stays about the same length. In this way, "flashing" of molten metal into gaps between successive blocks is effectively prevented.

In summary, up until the present invention, the only known function for the back-breaker apparatus, in its deflecting a local arcuate concavity in each return reach of each edge dam loop, was to cause the remainder of the dam blocks to be pressed endwise together in order to avoid gaps between successive blocks, thereby avoiding the troublesome "flashing" of molten metal into such gaps, which flashing produces undesired fins on the cast product and which fins or flashings occasionally disrupt the continuous casting operation. In other words, for many years in many different countries, the technical experts in many different companies have been using twin-belt continuous casting machines with back-breakers for closing up the gaps between the edge dam blocks for preventing flashing of molten metal into gaps between blocks, and no one has previously conceived of relatively elevating and lowering the respective back-breakers for synchronizing the movements of the edge dams.

SUMMARY OF THE DISCLOSURE

This invention relates to a continuous metal casting machine wheein two opposed edge dams (side dams) revolve in a loop that cycles through a moving mold of the machine such as a twin-belt caster in a way to continuously cast a shaped, contoured or profiled product such as cast-in lugs or hangers, shoulders, lobes, curves, depressions, or indentations, all at longitudinally spaced positions along both edges of a cast metal slat, strip, bar, or strand generally referred to as the cast product. Alternatively, there may be contoured projections or lobes, instead of depressions in the edge dam strings, for the purpose of casting depressions or hollows in the cast product.

It is an aspect of the present invention to provide a new and improved method and system for edge dam synchronization and product profiling and shaping in continuous casting machines in general and in twin-belt casting machines in particular, such as are currently utilized for the continuous casting of copper anodes with integral cast-in lugs projecting from opposite edges of the anodes.

Among the advantages of this inention are a broader range of cast product shapes and applications, together with enhanced synchronization control of edge dams and provision of flexibility in modes of such control. Such controls may be in turn synchronized with a pinch roll stand and with cutting or torching mechanisms, thereby allowing for increased automation and greater productivity and consistent quality control, relatively free from human error.

Among the further advantages of the present invention are the provision of a powerful and positive means of control of synchronization of the edge dams to enable stable automatic operation under a wide variety of conditions, including even the condition of an edge dam loop being bound together by a high strength longitudinal unifying member, such as a metal strap, which allows for deviation in manufactured length of as much as $\frac{1}{4}$ inch difference (6 mm) in the cumulative lengths of the blocks strung onto each of such straps. Continuous synchronization of the relative position of opposing edge-dam pockets is normally controlled merely by thermal means to position errors of no more than $\frac{1}{8}$ inch (3 mm). Advantageously, position errors of as much as $\frac{7}{8}$ inch (22 mm) are quickly brought under control to within a tolerance range of $\pm 3$ mm by means of the present invention.

In accordance with the present invention, the back-breaker apparatus is driven up and down by lift means--for example, a linear actuator such as a fluid-powered cylinder, which is included in an edge dam synchronization control system that can be manually or automatically operated. This linear actuator raises and lowers the cooling chamber under each edge dam, while at the same time raising and lowering the back-breaker apparatus along a predetermined range of travel. The cooling chamber and the back-breaker apparatus are advantageously combined as a single sub-assembly. A load-measuring cell is placed under each set of back-breaker rollers in such manner that this cell in effect weighs varying lengths of the edge dam along the return path. This cell is normally a force-responsive electrical transducer. The lengths of the edge dam that are weighed by means of this load cell increase with the increasing upward thrust of the back-breaker with respect to the sagging return path of the edge dam, thereby generating an increasing signal from the load cell. This signal resulting from the weighing by the load cell is used to require the synchronizing control system to remain confined to predetermined "safe limits" of upward and downward travel of the back-breaker apparatus, within which either manual or automatic control may be allowed to function in response to the signals of error in dam block synchronization.

The lower safe limit of back-breaker travel is fixed according to the least amount of endwise pressure or compacting force to be applied to the edge dam blocks, as part of the dam loop, that will ensure that there will be no "flashing," i.e., no open gaps between the dam blocks into which molten metal could flow as the blocks enter the mold. The upper safe limit to the back-breaker travel is determined by the lesser of as many as three factors: (1) The first is the greatest safe tension bearable by the longitudinal high-strength metal-unifying member of the edge-dam loop (the metal strap, cables, etc.) (2) The second limiting factor is the longitudinal endwise pressure above which edge dam blocks will tend to buckle or tilt up with respect to each other in a longitudinal vertical plane and so to become misaligned and bind. The longitudinal endwise pressure or compacting force is kept below the block buckling and binding level, so that each of the blocks will remain in mutually straight alignment with its neightbors, untilted about transverse axes, so that the successive blocks will move smoothly in alignment without binding and without causing undue wear into the entrance to the mold. (3) A third limiting factor is the undue wear on the corners of blocks where forces against each other.

The purpose of the edge dam synchronization system is to synchronize the movement of the two edge dams along opposite sides of the mold in order to keep the opposed sets of lugs on the cast product optimally squarely and directly opposite each other or, if desired, to maintain some other consistent relationship between the two edge dams for purpose of shaping or profiling the product being cast. By raising and lowering each back breaker within such predetermined "safe" limits for changing the curvatures of the paths of travel of the two edge dams, in response to error signals from synchronization-control sensors at the edge dams, a very powerful and effective edge dam synchronziing method and system is provided.

We have discovered that the higher a back-breaker is raised within the predetermined safe limits, the greater is the tension in the longitudinal unifying member in the affected edge dam loop--notably, in the metal strap or cable that carries the edge dam--resulting in effective compression between the blocks. We believe this compression serves elastically to push down slight asperities of the mutually contracting faces of the blocks and so controls the compressed blocks in such a way as to become optimally spaced or compacted. Hence, the blocks so compacted or compressed go through the moving mold in controllably greater numbers per unit time than those in the other edge dam, where the back-breaker is not raised so much. Linear speed is not affected; nevertheless, the blocks in the affected edge dam advance in slightly greater numbers than the less compressed blocks in the other edge dam, due to the effectively shorter length that results from such compression effects. Regardless of the validity of this theory of the effects of metal straip or cable tension in producing elastic compression of asperities in the contacting faces of adjacent blocks, we have discovered that to controllably raise one of the back-breakers within a predetermined range relative to the other back-breaker, in order to cause a greater edge-dam-string tension in one loop or chain or string as opposed to the other, serves effectively to speed up the edge dam associated with that elevated back breaker, relative to its correspondingly parallel opposed dam. In connection with this explanation of the "speed-up" effect produced by elevating one back-breaker relative to the other, it is to be noted that the edge dam blocks in each loop are strung onto their respective longitudinal carrying means such as a strap, chain, or cable, shown herein as an endless metal strap. yet they are not fastened to this endless strap, and thus, the strap provides freedom for each and every block to slip longitudinally in relation to any adjacent block and conversely each and every block is free to be spaced or compacted and to slip along the carrying means when the interrelationship between the blocks so requires.

This "slip factor" allows for controlled interplay between edge-dam blocks and the carrying means--the strap or cable itself--and is evidently a phenomenon employed to advantage in the effective use of the method of control herein described.

This new technology may be utilized to advantage in existing twin-belt anode casting installations in conjunction with the prior thermal methods used for edge-dam synchronization. That is, this present back-breaker control may be operated manually in response to gross edge-dam deviation or error in synchronization, which are beyond effective control when using only the prior edge-dam heating and cooling methods. By experimentation, we have found that a correction in synchronization of the moving edge dams made by manually changing a back-breaker setting will usually suffice for several hours of uninterrupted casting, so long as the heating and cooling of the edge dams are automatically controlled meanwhile. However, the concurrent use of continuous heating or cooling requires energy. This energy-cost consideration and the avoidance of other complexities may ultimately result, we believe, in abandoning the heating or cooling methods, in favor of employing the present invention by itself.

As used herein, the term "cast product" or "product being cast" is intended broadly to include a strip, a bar, or a slab, because this invention can be employed advantageously for continuously casting any of these products requiring a cast-in shape, profile, extension of indentation as generally described above, whether located on directly opposite sides of the cast product or not. The term "intergral shoulders" is intended to be interpreted broadly to include any predetermined configurations or shapes being integrally cast on opposite edges of the product, for example protrusions or outwardly projecting lugs or profiled depressions, indentations, notches, or sockets. The term "integral shoulders" includes shoulder-like regions so shaped as to enable subsequently cut sections of the product to be conveyed, handled, supported or mounted, cut, or stacked in a predetermined manner. For example, an "integral shoulder" may be of the full thickness of the product, or it may be a fraction of that thickness. As further examples, the term "integral shoulders" is intended to include more complex configurations including both outward and inward formations of the edges of the cast product. The shoulders are not necessarily to be cast squarely opposite one another but may instead be disposed according to some other repetitive pattern required by the end use of the product. Two examples of shapes and dispostions of shoulders will be presented in the detailed description.

The aforementioned load cell which weighs a moving edge dam loop may alternatively or additionally be placed where it will sense some edge-dam guide roller or rollers other than those mounted on the "back breaker" or the attached edge-dam cooling chamber. For example, such a load cell may advantageously be placed so as to work in cooperation with a roller guide that is near the entrance to the moving mold. This location of a load cell near the entrance has the advantages of avoiding the difficulty of servicing a load cell associated with back-breaker apparatus and also of avoiding the adverse effects of random contact with aqueous coolant, as well as avoiding inherent anomalous dynamic effects within the edge dam loop itself. However, when a load cell is loated near the entrance, protection from radiant heat may be required, for example by air piped in, when metals of high melting point are being cast. While a roller load cell assembly in this high position near the entrance does not "weight" much of the edge dam in a usual sense, the signal from the high-mounted load cell near the entrance appears to respond to changes in tension in the moving edge-dam loop at least as efficiently as when a load cell is near the back-breaker apparatus.

An additional feature of the present invention is the conjunction and interaction of other devices with a load cell, the resulting assembly being mounted near the entrance to the moving mold in conjunction with each edge-dam string, as just discussed.

The "back-breaking" principle, already fully described, may be used in an inverted arrangement at this critical entrance location for a different purpose, namely, for increasing the reliability of the seal of the moving edge damp loops against the lower casting belt, especially in the case of open-pool pouring--i.e., the method of introducing molten metal into the moving mold without any semi-sealing snout or nozzle, as provided for by the belt/pulley configuration shown in FIG. 12. The last edge-dam entrance guide roller on each side is supported through a load-measuring cell. Unlike the preceding edge-dam guide rollers, this last roller is positioned to contact the top of the moving edge dam loop, in such wise as to force the moving edge dam loop down against the lower casting belt at a point downstream from this top-contacting roller. As mentioned above, one result is a controlled "compacting" of the dam blocks, each against the other. In addition, the present point is that the critical interstice between the bottom sof the edge dam blocks and the lower belt is hereby sealed more reliably in the area in which molten metal first contacts the edges of the moving mold. Thus, the sealing effect resulting from a single, advantageously placed, last and top-contacting roller is an action in two directions: (1) the interstices between blocks are closed by a controlled longitudinal pressure, especially locally, where cumulative friction is not restrictive of block sliding; and (2) any residual interstice between the blocks and the lower belt is closed by vertical pressure. This last roller or wheel guide with its bracket may be called the levered dam seal. This sealing effect is of special importance in the casting of metals of high melting point, especially steel, for in steel the oxides, which are generally present at high temperatures, are molten at the pouring temperature of the steel. This fact of molten oxides renders the flow of molten steel water-like in its low surface tension and therefore necessitates unusually thorough sealing of the moving mold, toward which sealing effect the present invention is a significantly, advantageous contribution.

BRIEF DESCRIPTION OF THE DRAWINGS

Other objects, aspects, features and advantages of the present invention will be apparent from the following detailed description of the presently preferred embociments considered in conjunction with the accompanying drawings, which are presented as illustrative and are not intended to limit the invention. Corresponding reference numbers are used to indicate like components or elements throughout the various Figures.

FIG. 7A shows a depression or pocket in the edge dam block which cast the shape of FIG. 6, together with adjacent plain blocks.

FIG. 7B is a side view of the dam blocks of FIG. 7A.

FIG. 7C is a transverse section view of the dam block of FIG. 7A.

FIG. 9 is a plan view of the lower carriage during casting, like FIG. 5 but with the present novel configuration of slab to make anodes, the electrolyte consumption of which will be more efficient than that with the prior configuration of FIG. 8.

FIG. 10A is a plan view of a small section of the edge dam used to cast the edge pattern of FIG. 9.

FIGS. 10B and 10C are a pair of cross-sectional views of the edge dam of FIG. 10A.

FIG. 12 is a detailed plan view of the apparatus of FIG. 12, shown enlarged.

FIG. 14 is a detailed elevation view of the apparatus of FIGS. 12 and 13, shown enlarged.

DETAILED DESCRIPTION

Figure 1:
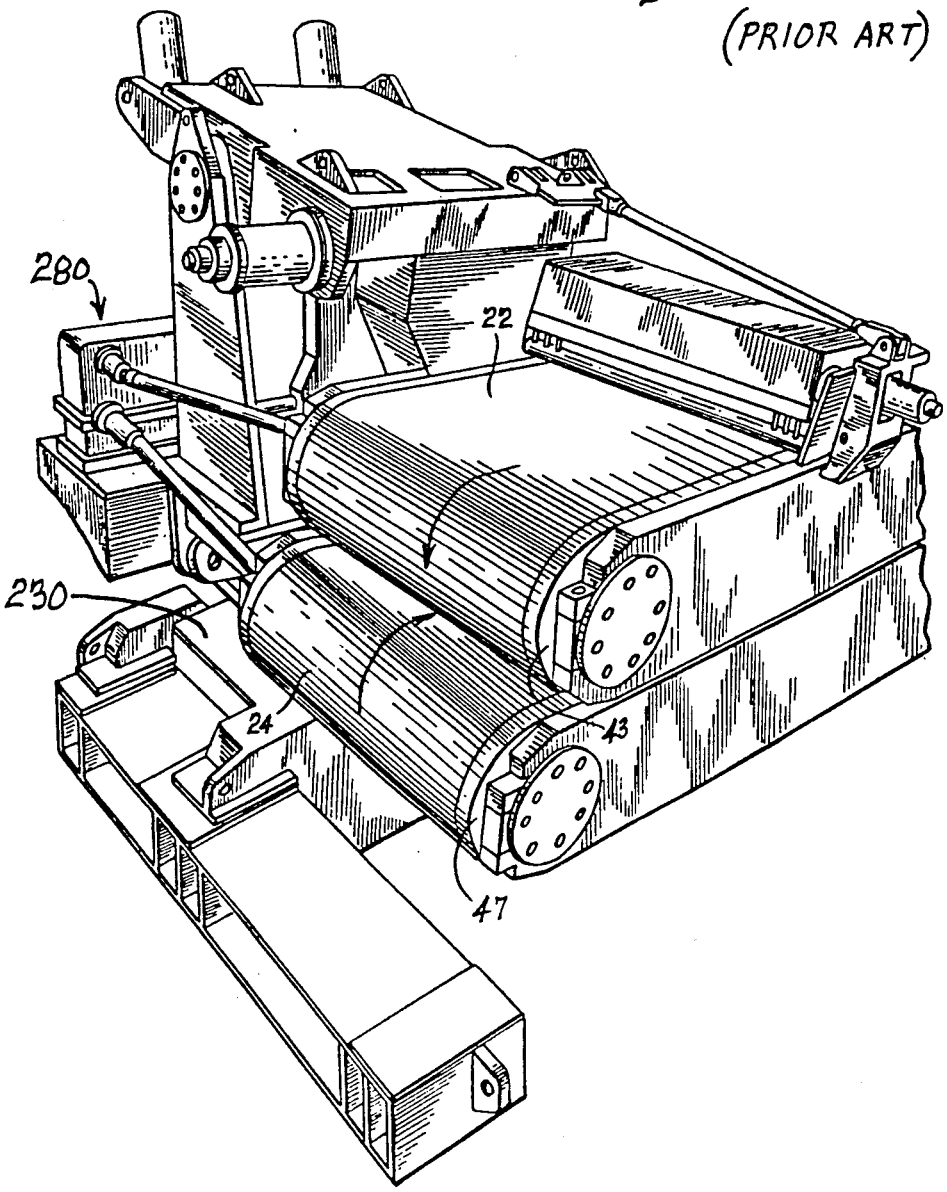
Fig. 1. (PRIOR ART)
FIG. 1 is a simplified perspective view of the input or upstream end of a generally horizontal continuous strip-casting machine in which any of the various aspects of the present invention may be incorporated. The view is that of looking toward the machine from in front of and beyond the outboard side of the two belt carriages. Edge dams are not shown in this view.
Figure 2:
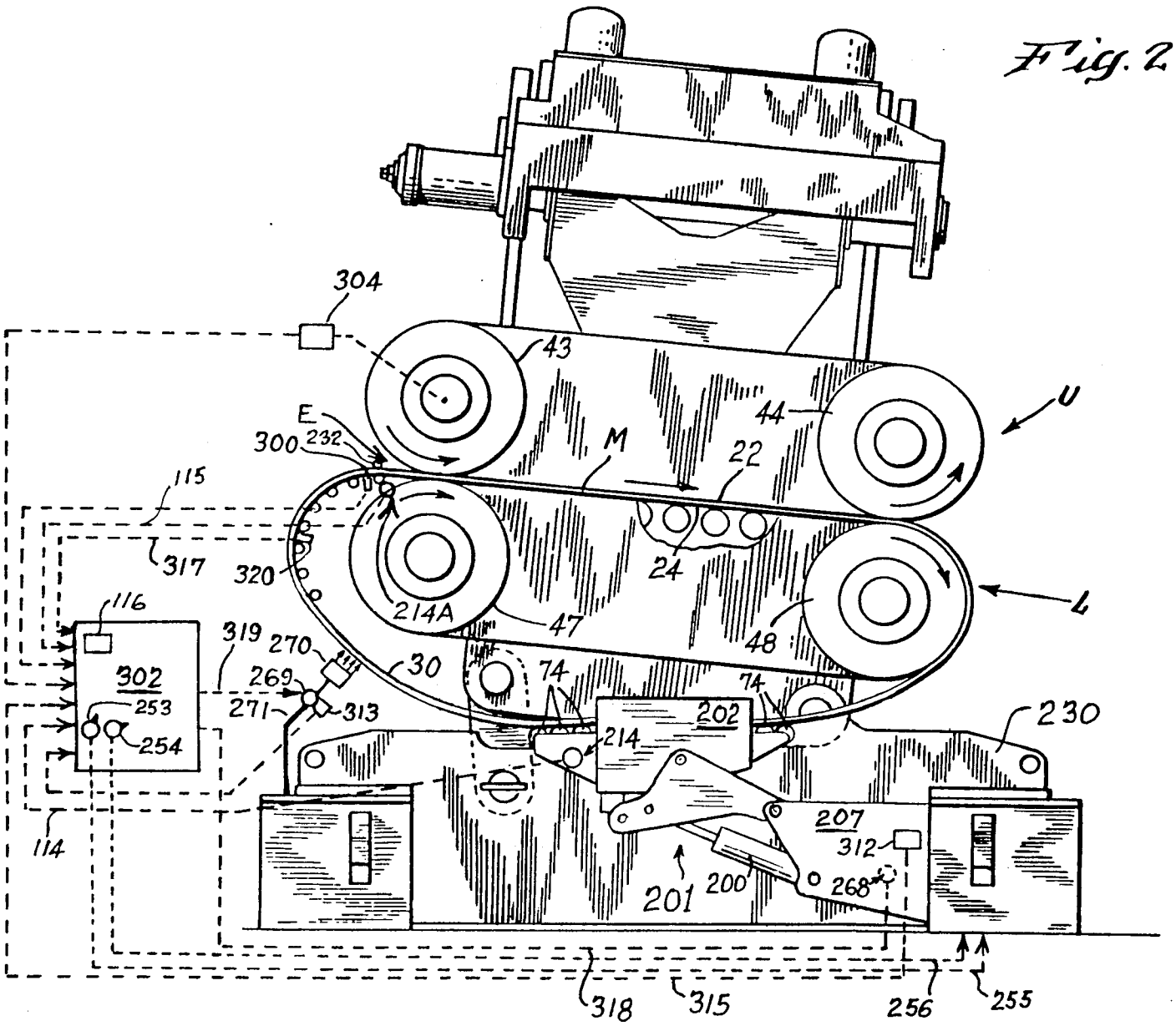
FIG. 2 is a side elevation view of the twin-belt continuous casting machine of FIG. 1. The roller tensing ("back-breaker") apparatus is shown.
Figure 3:
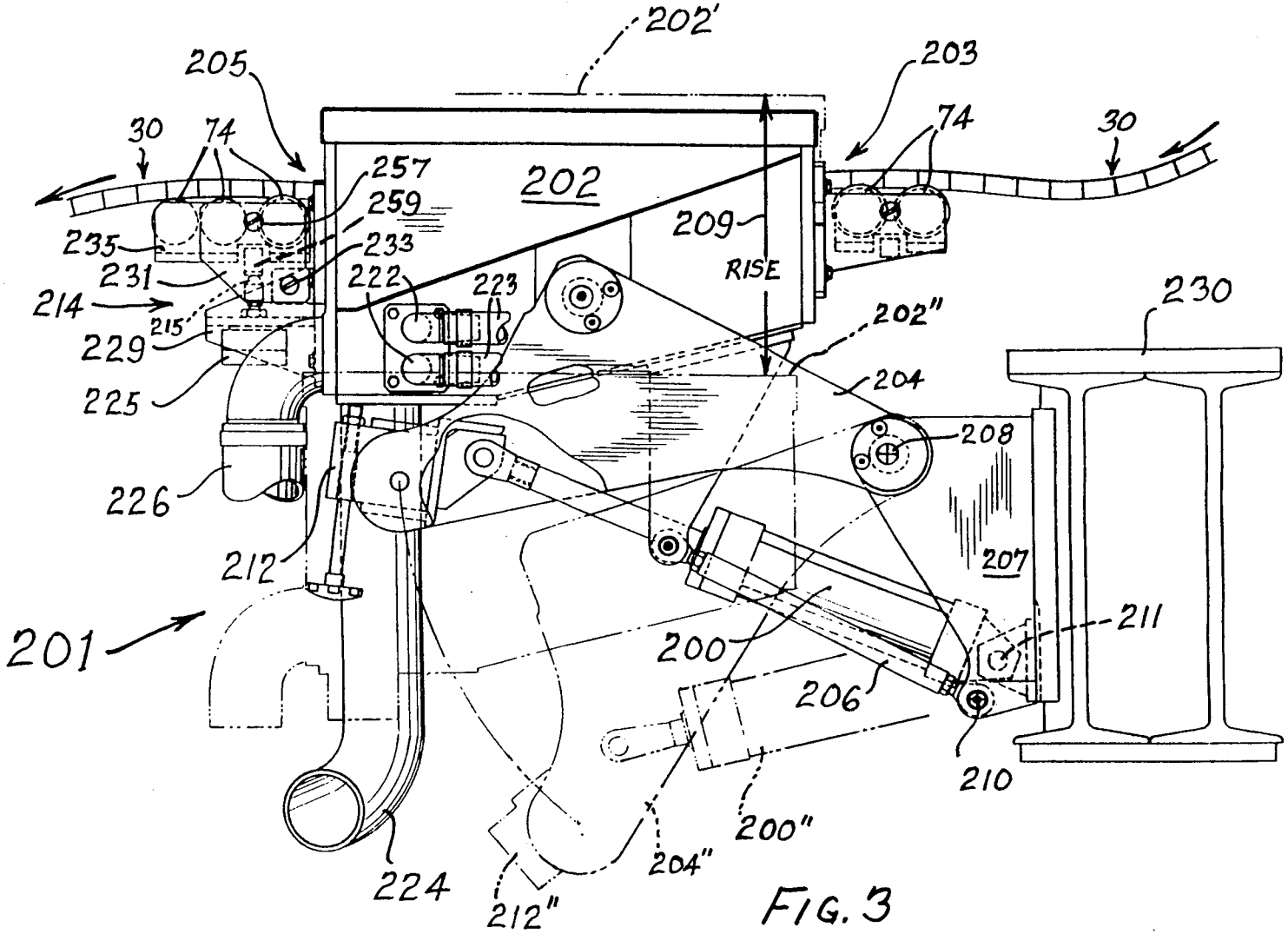
FIG. 3 is a detailed elevation view of the back-breaker apparatus including cooling and heating elements for the respective edge dam, which is the outboard edge dam.

In the twin-belt continuous casting machine shown in FIGS. 1 and 2, the upper belt is shown at 22, the lower belt at 24; the upper upstream pulley is indicated at 43, the lower upstream pulley at 47. This machine, incorporating the present invention, is shown in FIG. 3. In the present embodiment of the invention, the vertical positioning of the back-breaker 201 and its rollers 74 against a moving edge dam 30 is here accomplished by a mechanical actuator such as a double-acting hydraulic-actuated cylinder 200. In this way, precise vertical positioning of the back-breaker 201, with its rollers 74 (pivotally mounted) is controlled at will, if desired, by manually operating remotely controllable vales (not shown) for controlling the flow of hydraulic fluid to and from the respective upper and lower ends of the double-acting hydraulic lift cylinder 200. The manually operable remote controls 253 and 254 (FIGS>2 and 15) are included in the controller 302 for separately raising or lowering the respective hydraulic lift cylinders 200 for the back breaker apparatus 201 for the respective edge dams 30.

Figure 4:
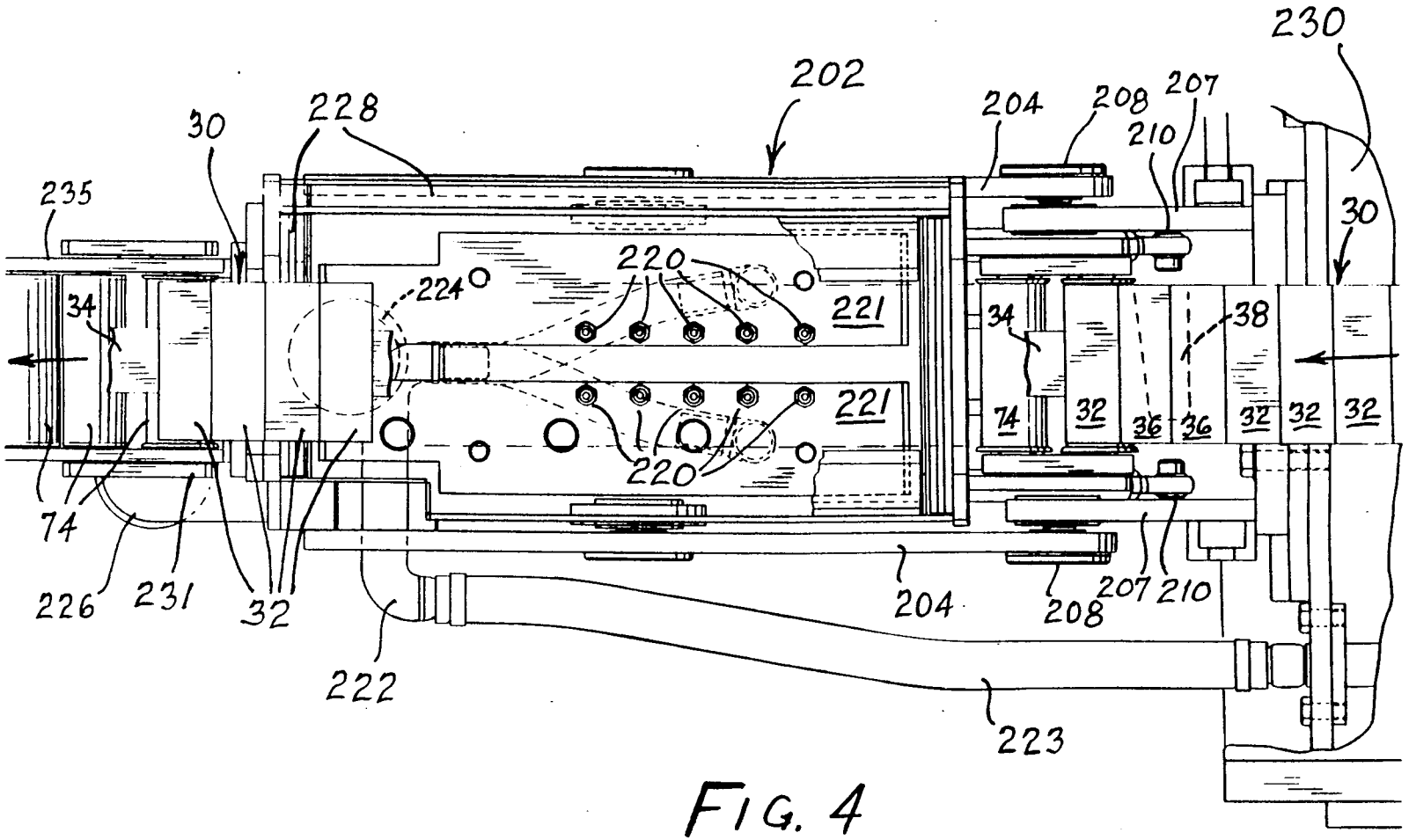
FIG. 4 is a top view of the roller tensing back-breaker apparatus of FIG. 3, together with cooling elements, for the respective edge dams.

The apparatus may advantageously be combined with a cooling chamber 202 through which the dam blocks pass, beind cooled by nozzles 220 (FIG. 4) on plenums 221. Water is supplied through hose lines 223 and enters the chamber through inlet conduits 222. There is a water drain 224 connected to the bottom of the chamber 202. An air blower exhaust conduit 226 is connected to the exit end of chamber 202. This exhaust line communicates with exhaust double-wall regions 228. In the back-breaker apparatus 201 as shown, the back-breaker rollers 74 are grouped at two locations--one at the entrance 203 to the chamber 202, and one at the exit 205. As shwon in FIG. 3, the entire back-breaker assembly 201, including the chamber 202 and the back-breaker rollers 74, is movably suspended by a pivoted four-bar parallelogram linkage, members 204 and 206, pivoted from the respective fixed pivots 208 and 210 and is made to rise and fall by the double-acting hydraulic lift cylinder 200. The whole assembly including the parallelogram linkage 204 and 206 is mounted by a bracket 207 to the base 230 of the machine.

There is a stop 212 for limiting the upper extreme position 200', so as not to cause overstress of the parts of the edge dam 30, in case the load cell assembly 214 is not installed or not used. The extreme elevated position 202' and the extreme retracted position 202'' of the cooling chamber 202 are indicated in dash-and-dotted outlines. The total rise is shown by the arrow 209. The lift cylinder 200 is mounted to the machine base 230 by a fixed pivot 211. There should be a minimum of 3 to 4 inches (76 to 102 mm) of usable vertical adjustment 209 when the rollers 74 are against the dams 30. The use of the load cell assembly 214 is preferred, in order to maintain proper limits on the tension within the flexible unifying loop strap or cable member 34 (FIG. 5) of the edge dam 30, which unifying loop is normally metallic. The structure and arrangement of the load cells will be described later.

Figure 5:
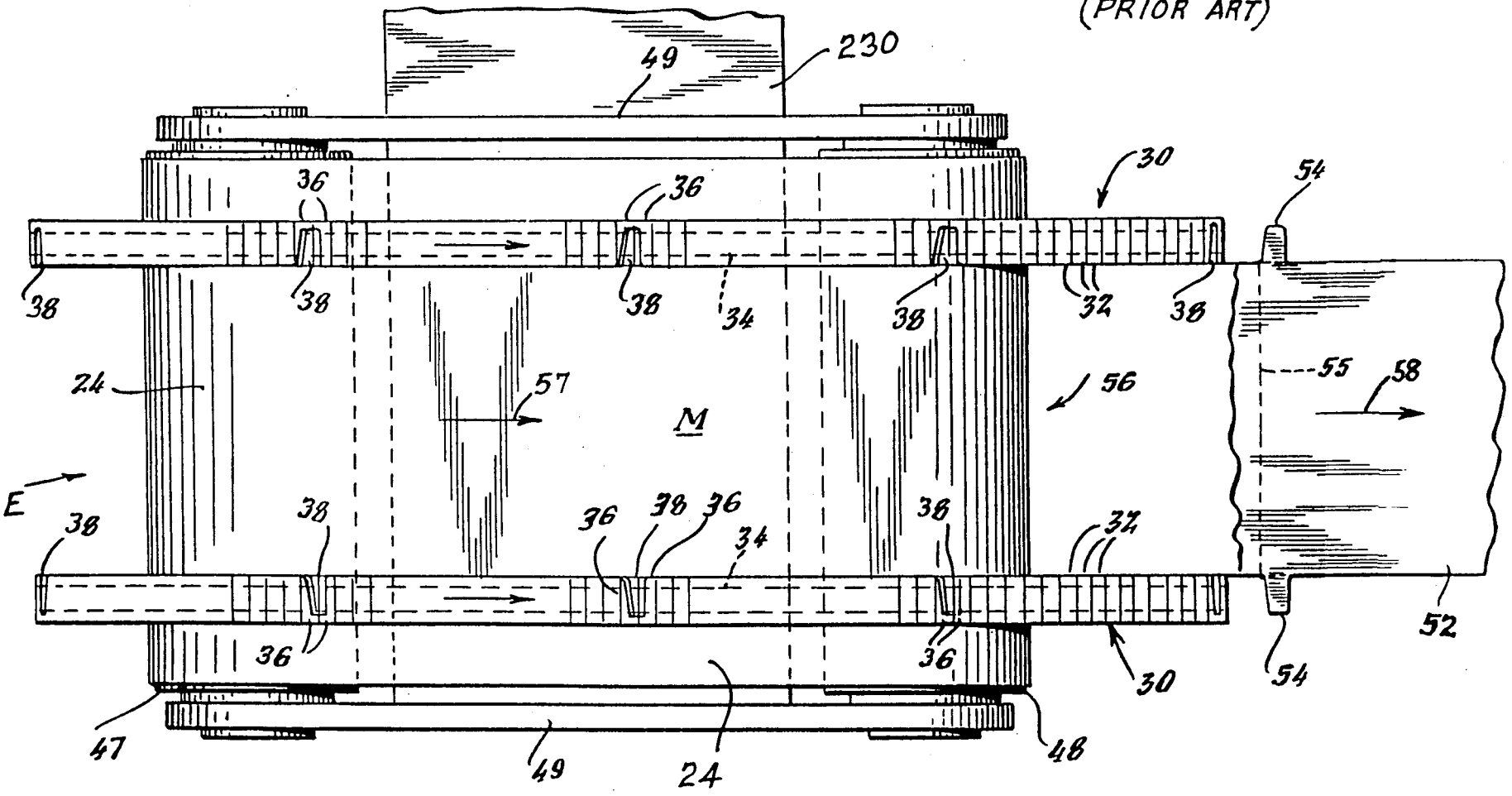
Fig. 5 (PRIOR ART)
FIG. 5 is a plan view of prior twin-belt casting apparatus with the upper carriage removed for clarity of illustration. Here is shown the emergence of slab with cast-in lugs in desired relationship to each other. Dotted lines show where the slab will be cut to make anodes.

A control of edge dam synchronization for cast-in lugs of anodes 52 (FIG. 5) has already been described in the referenced U.S. Pat. Nos. 4,150,711 and 4,586,559. In FIG. 5, each of the two traveling edge dams 30 comprises a multiplicity of dam blocks 32 strung in end-to-end relationship onto an endless flexible unifying member 34, shown as a strap. These dam blocks 32 can slide freely relative to their carrying strap loop member 34. At spaced positions along the length of each edge dam 30 there are special dam blocks 36 defining mold pockets 38 for casting the lugs 54 (FIG. 5) or 218 (FIG. 6) on the cast product 52. This cast product will subsequently be cut along the dashed line 55 to form an anode for electrolytic refining. FIG. 5 shows the lower upstream pulley roll 47, the lower downstream pulley roll 48, the lower belt 24, and two side frames 49 of the lower belt carriage of the twin-belt casting machine. The moving mold M progresses in the direction 57 and is defined between the two edge dams 30. The cast product 52 is discharged as shown by arrow 58 from the downstream or exit end 56 of the moving mold M. The apparatus and method described in this paragraph are more fully described and claimed in the referenced 4,150,711 and 4,586,559 U.S. patents. The following description is of different apparatus and method intended for the same purpose.

Figure 15:
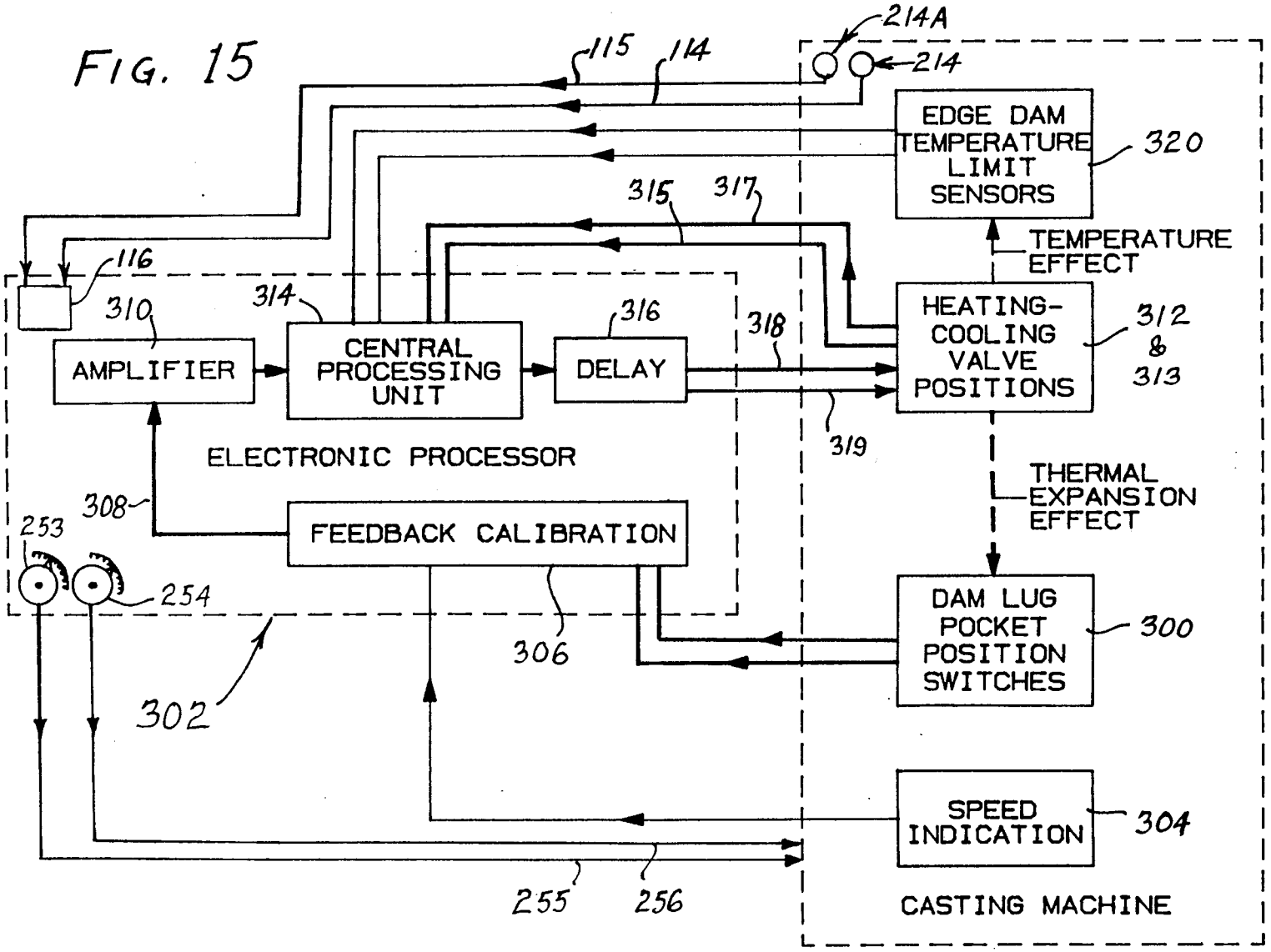
FIG. 15 is an electrical schematic drawing of a circuit for the automatic controlling of edge-dam synchronization.

The position of the lug pockets 38 in the edge dams 30 is sensed by mechanical switches 300 (FIGS. 2, 12, and 15)--for example, standard small limit switches. These sensors 300 are located just upstream from the entrance E (FIGS. 2 and 12) to the moving mold M (FIG. 5) of the casting machine. The limit switches 300 for the two edge dams 30 are operated directly by the lug pockets 38 for providing an electrical signal when each lug pocket 38 is sensed. The resulting sets or pairs of signal data $\Delta T$ are in terms of time. These data signals are fed into an electronic processor 302. These signals are qualified by a desired adjustment in the feedback calibration circuit 306 in FIG. 15, which corrects for startup error. Startup error may be due to misalignment of the sensor-switches 300. At the beginning of an anode cast, the two edge dams 30 are necessarily already synchronized, since a shaped movable starter bar (not shown) that is inserted into the mold M (FIG. 5), to plug the casting mold temporarily assures accurate lug pocket alignment at first. In addition, this feedback calibration circuit 306 can be adjusted to bring about an intentional misalignment or offset, if desired, between the two dams 30 and hence also between the pairs of lugs 54 (FIG. 5) or 218 (FIG. 6) cast therein.

The casting speed 57 (FIG. 5) is sensed by a tachometer generator or other rotating speed sensor 304 (FIG. 15), operatively associated with the drive transmission 280 (FIG. 1) of the twin-belt casting machine. The signals from this speed indication sensor 304 are fed into the feedback calibration circuit 206 in order to compensate for the actuate speed of the machine. A given difference in time $\Delta T$ between the signals from the lug pocket sensors 300 for the two edge dams 30 corresponds to a larger positional error $\Delta L$ the faster the machine is running. A proportional adjustment for caster speed as sensed at 304 is made in the feedback calibration circuit 306, so that the resultant signal emerging at 308 reflects the synchronization error as converted to distance error instead of a time error--that is, as $\Delta L$ instead of $\Delta T$. The resulting signals 308 are fed into an amplifier 310 and amplified by a factor K.

The flow of coolant water through the supply lines 223 (FIGS. 3 and 4) is regulated by automatically controllable valves having valve actuators 268 mounted on the machine frame 230. Thus, the amount of coolant supplied to the nozzle manifolds 221 in the respective cooling chambers 202 for the two moving edge dams 30 is separately and remotely controllable. Valve position sensors 312 (FIGS. 2 and 15) are associated with the respective valves for providing electrical signals indicating the valve position and thereby indicating the amount of cooling sprays being applied to the respective moving edge dams. The control-valve position-indicating electrical signals come from the sensors 312 and are fed into a centrl processing unit 314, where the signals from valve-position sensors 312 are subtracted from the output of amplifier 310. The valve-control signals from the central processing unit 314 are in turn subjected to an adjustable time delay by an adjustable delay circuit 316, for providing a time delay between the sensing of an error and the transmission of an actuation signal 318 to the respective coolant water flow valve actuator 268 (FIG. 2) and/or transmission of an actuation signal 319 to the respective gas flow valve actuator 269 (FIG. 2). This delay in the transmission of the respective actuation signals 318 and 319 is to allow for and to compensate for the physical delay in the process itself, which is normally referred to as process lag. Such delay in transmission of the actuation signals 318 and 319 is useful for preventing overshoot of control.

Each moving edge dam 30 may be heated by a radiant heater burner 270 (FIG. 2) supplied with gas through a line 271 regulated by a remotely actuatable gas valve 269. A temperature sensor 320 (FIG. 2) senses the temperature of the respective moving edge dam 30 before it enters the entrance E of the moving mold M and provides signals to the controller 302 for keeping the temperature of the edge dam within the specified temperature range. As shown in FIG. 2, the position sensor 312 senses the position of the actuable coolant flow control valve 268, and a position sensor 313 senses the position of gas flow control valve 269. Signals from these respective sensors 312, 313 are fed to the controller 302 as shown by the lines 315 and 317 in FIGS. 2 and 15. As shown by the control lines 255 and 256 in FIGS. 2 and 15, the manually operable remote controls 253 and 254 serve to operate hydraulic valve actuators for separately controlling the elevational positioning 209 of the hydraulic lift cylinders 200 of the respective back-breaker apparatus 201 for the two edge dams 30.

The system permits modest error up to a predetermined first amount without responding to it. The amount of this modest first tolerance is under operator control. When the error or difference $\Delta L$ exceeds this predetermined first amount, the quantified error signal is made to result in a command signal 318 or 319 being sent to heating or cooling valves which control the heaters 270 (FIG. 2) or the water supplied to jets from nozzles 220 (FIG. 4) in the cooling chamber 202, thereby closing the control loop. Three degrees of proportional gain K in the amplified response are selectable by the manually adjustable amplifier 310--fine, medium, and coarse. The operator can adjust the three error ranges in which each of these three degrees of response come into play.

So long as the positional error $\Delta L$ remains below the modest first predetermined amount, the positions of the heating and/or cooling valves are not changed, as explained above. The fine, medium, and coarse responses thus depend upon predetermined selected ranges of error above the first predetermined amount. The fine response is used for an initial range of errors above the first predetermined amount. The medium response is used for an intermediate range of errors larger than the initial response range. The coarse response is used for the largest errors, above the intermediate range. In other words, progressively greater corrective action is automatically provided in response to progressively greater positional errors $\Delta L$ in order to maintain synchronization without undue overshoot or destabilization of overall control.

The heaters for edge dams 30 are normally operated with gas burned in radiant heaters 270 adjacent to the edge dams 30 and located toward the entrance E of the moving mold M from the back-breaker 201. When the edge dam blocks 32 and 36 are transvesely wide in comparison with their thickness, as occurs in anode casting, the use of heat may be preferable to cooling, though cooling may be required on an opposite edge dam 30 if heating on the one edge dam is insufficient to attain a needful difference of thermal change in size, in order to re-establish synchronization. The temperature of the dam blocks is kept preferably above 110° C. to be rid of moisture when the dam blocks enter the entrance E, and below 200° C. to lengthen the life of the dam blocks. This temperature may be measured by contact thermoelectric devices 320 or by infra-red radiation sensors. This temperature information from each snesor 320 is fed into the central processing unit 314 to override conflicting synchronization demands for keeping the edge dams 30 near the entrance E within the specified temperature range of 110° C. to 200° C.

The relative position of the cast lugs 54 or 218 on the anodes may additionally be sensed as they emerge from the downstream end 56 (FIG. 5) of the machine. However, this latter signal from sensing the lugs themselves is used for operator information only and not for automatic control in this embodiment of the present invention.

A load cell assembly 214 (FIGS. 11 and 3) is shown for sensing the tension of the flexible, high tensile strength cable of strap member 34 in each edge dam 30. Piezo-electric crystal load cells have been tried successfully, but a high load rating capability should be selected as they are fragile under impact loads. A load-bearing cap 215 is mounted on a movable plunger 214 having its lower end fitting 217 resting on the sensor button 219 of load cell 216.

Figure 11:
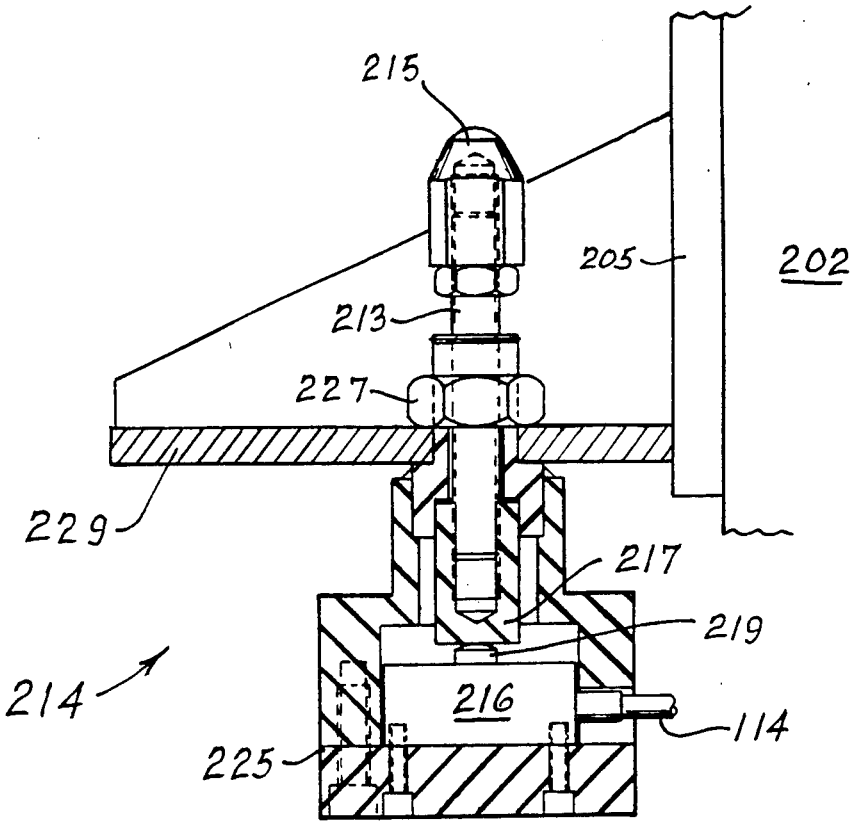
FIG. 11 shows the load cell assembly in detail, enlarged from the left side of FIG. 3.

The load cell 216 (FIG. 11) is seated in a housing 225 fastened by a mounting nut 227 to a bracket 229 secured to the exit end 205 (FIG. 3) of the cooling chamber 202. A movable roller carriage 231 (FIG. 3) which carries a plurality of rollers 74 is mounted by a fixed pivot 233 to the cooling chamber 202. The rollers 74 are located on a bogey unit 235 which is pivoted by a pivot 257 to the carriage 231 The carriage 231 has a pressor foot 259 which is offset from the pivot 233 and bears upon the load-bearing cap 215 of plunger 213 (FIG. 11). Thus, the load cell assembly 214 (FIG. 3) senses the load of the edge dam 30 exiting from the exit end of the cooling chamber 202 and transmits the resulting signal through a conductor cable 114 to a readout display 216 (FIGS. 2 and 15) in the controller 302. The purposes of the load cell 216 is to indicate and limit the range of excursion 209 through which the chamber 202 and, with it, the back-breaker rollers 74 may operate within specifications for the edge dam cable or strap member 34. For if the chamber drops too low, the internal tension in the dam block strap 34 will fall, and open gaps will appear between the dam blocks 32 (and 36), allowing troublesome fins to be cast in the gaps. But if the chamber is allowed to travel too high, the strap 34 within the moving edge dam 30 upon which the blocks 32 (and 36) are strung will be stretched, or the blocks will bind against each other, or the corners of the blocks will be prematurely worn, all as the result of high mutual compressive forces between the blocks.

The load cell 216 advantageously enables the measurement readout 116 (FIGS. 2 and 15) of the load of the edge dams upon the rollers 74 mounted on the exit end 205 of the chamber 202, in order to manually operate the back-breaker elevational controls 253 and 254 to keep the chamber and back-breaker movement within appropriate up-and-down limits 209. The load range for one edge dam corresponding to the range of elevation 209 is desired to be, for example, from 15 to 100 lbs. (7 to 45 kgs.). The higher end of this load range is relevant to wide dam blocks such as are used in the casting of cast-in lugs 54 or 218. The load on the load cell 216 should not, in our view, ever exceed 250 lbs. (113 kilograms). However, that load limit is not absolute as it depends on the particular weight of the edge dams, their length, and their tightness. Three factors in this limiting of the up and down travel 209 (FIG. 3) were discussed earlier, in the Summary.

Figure 12:
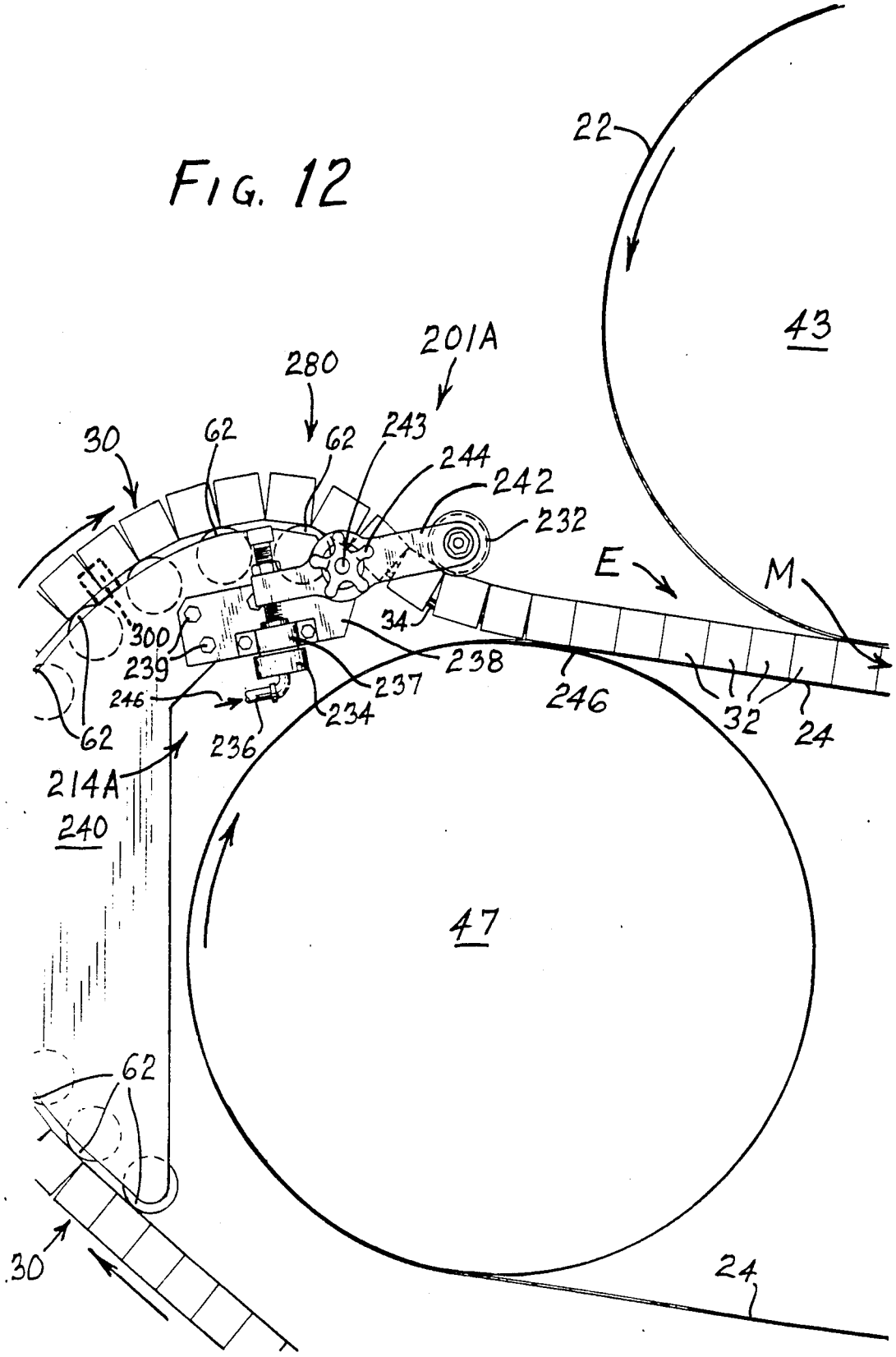
FIG. 12 is a schematic elevation view of the high front-mounted load cell and levered dam seal, in its setting. The pulley arrangement is suitable for open-pool pouring.

The aforementioned load cell assembly 214 which weighs or senses the tension within a moving edge dam loop or string 30 may advantageously be placed higher relative to the edge dam loop, where it is referenced as assembly 214A (FIGS. 12, 13, and 14). There, a load cell 216 in a housing 234 participates at the end of a pivoted cantilever arm 242 in the loading of an edge dam guide roller 232 with the aid of an adjustable presser bolt 248. This roller 232 is adjustably supported by the cantilever arm 242 from a bracket 238 mounted upon each crescent frame 240. This roller 232 guides the edge dam string 30 into the mold entrance E. This roller 232 is the last and generally highest guide roller, and it contacts the moving edge dam loop 30 from the top or outside, unlike the other guide rollers 62. Thus, roller 232 is relatively near the entrance E to the moving mold M as shown in FIG. 12. This near-the-entrance location of the roller 232 has the advantage of being away from falling and splashing water and is moreover there freed from anomalous unwanted dynamic effects to which a low-mounted load cell assembly 214, attached to chamber 202, is subjected. These dynamic effects are associated with the long, suspended and divided return reach of the edge damp loop 30 and are forestalled by the alternate high and dry front location 214A. In the upper location 214A, the load cell 216 is also more accessible for service. If there is too much radiant heat for the lift of the load cell 216 in the housing 234, as when metals of high melting point are cast, cooling air 246 can be piped into the housing 234 through a conduit 236.

The housing 234 of the roller load cell assembly 214A is secured by a mounting saddle 237 to a bracket 238 secured by bolts 239 to the crescent frame 240. The adjustable presser foot bolt 248 presses down upon a movable plunger 241 which in turn presses down upon the button 219 of the load cell 216. The cantilever arm 242 which carries the roller 232 acting as a fulcrum and having a tightenable hand nut 244. The guide roller 232 is mounted on one end of the lever arm 242, and the presser foot bolt 248 is mounted on the other end 245 of this lever arm. Thus, upward force on the roller 232 causes downward force on the presser foot 248 and on plunger 241 and load cell 216. The resultant electrical signal is fed over an electrical cable 115 to the readout display 116 in the controller 302.

The load cell assembly 214A in this high position does not "weigh" much of the edge dam 30 in a usual sense, but that is an advantage relative to the location 214 near the cooling chamber 202. A reason for this advantage is that, when the load cell 216 is placed underneath the casting machine in assembly 214, the heavy static load of much of the whole return reach of the edge dam 30 dilutes or tends to swamp the desired tension-related signal resulting from tension in the moving edge dam strap 34 much more than in when in the high position 214A. The weight or effect of individual dam blocks 32 or 36 is not intended to be sensed by either load cell assembly 214 or 214A. It is the tension in the strap or cable member 34 which is of interest. Roller 232 and cantilever arm 242 are adjustably clamped by the hand-nut 244 on the pivot shaft 243. A spring washer 247 (FIG. 13) provides resilience when tightening the clamping means 244.

A load cell is not the only way to determine the appropriate limits 209 (FIG. 3) of up-and-down travel of the backbreaker apparatus 201. This determination of the amount of tension in the strap or cable member 34 can also be done by optically sensing the shape of the path that an edge dam 30 follows after it exits from the chamber 202, by a sequence of photocells. Any increasing tightness that may be imposed on the cable of strap member 34 of an edge dam 30 is revealed by the increasingly convex, swelled-out shape of this path between the exit end 205 of the chamber 202 and the top of the crescent frame 240. However, this photocell method is more complex than the advantageous load cell sensing described above.

Figure 8:
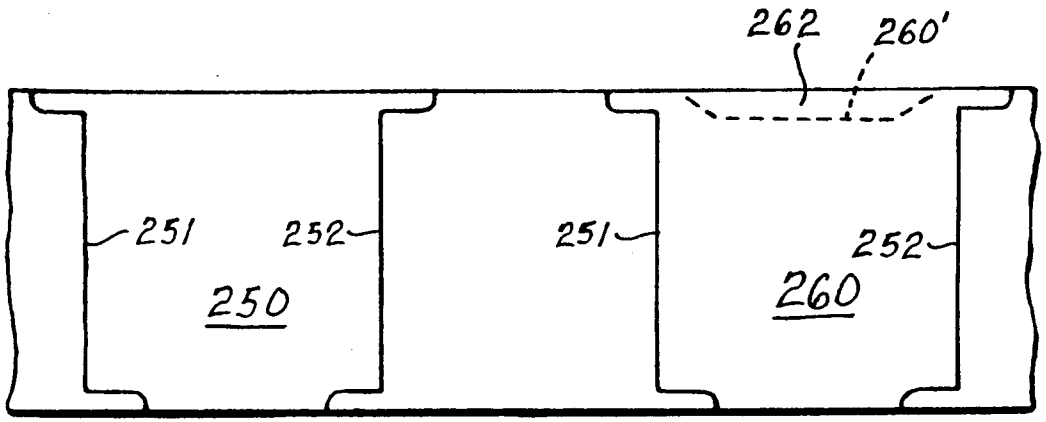
FIG. 8 shows an alternate mode of copper anode cutting which uses as its material straight-sided slab and does not use cast-in lugs.

A load cell assembly 214 or 214A may advantageously be used also for automatic prevention of open gaps between dam blocks 32 (or 36), when the product of the casting machine is not anodes or other cast product with shoulders but has straight edges as shown in FIG. 8. Such straight-edged cast products do not require edge dam synchronization. The load cell assembly 214 or 214A automatically maintains a given suitable range of tension in the edge dam unifying loop or strap member 34. As explained before, too low a tension in the edge dam loop member 34 results in open gaps and casting finning, but too high a tension results in needless wear of the corners of the edge dam blocks 32 and may endanger the high-tensile-strength unifying strap member 34 upon which the dam blocks are strung. In this case, the desired range of control is selected between the permissable extremes.

Figure 6:
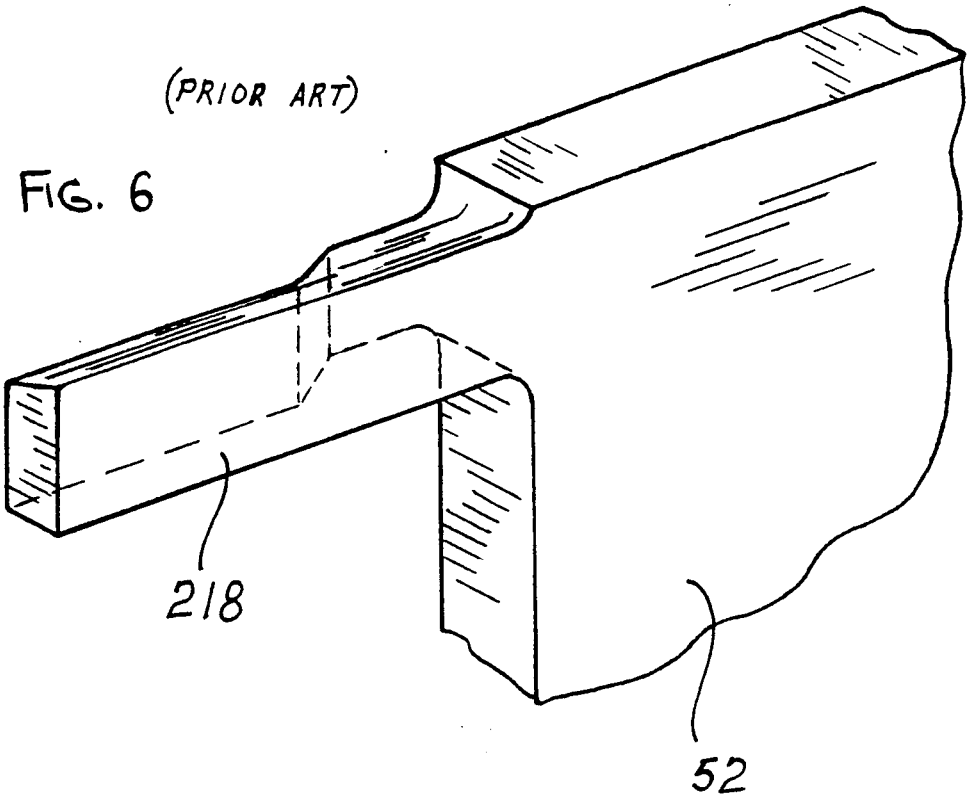
(PRIOR ART) FIG. 6
FIG. 6 shows a portion of an anode with a cast-in lug which is of full thickness for part of its length and of partial thickness for the outlying part of its length, such an anode slab with a lug being an example of casting that is done on a twin-belt machine shown in FIGS. 1, 2, and 5.

Various shapes of lugs may be cast, including partial thickness lugs 218 that are cast inpockets 38 as shown in FIGS. 6 and 7A, 7B, and 7C. Again, the lugs for support of anodes need not be the same thickness throughout their length. Under some conditions, as with anodes of low thickness, placed in existing tanks, the lugs 218 may advantageously be made of full thickness for part of their length and of a lesser thickness over the outlying part of their length, as shown in FIG. 6. FIGS. 7A, 7B, and 7C show the depressions or pockets 38 in the edge dam blocks 36 which cast the lug shape 218 of FIG. 6. The lugs 218 may each be cast within one block or by two adjacent blocks. The outlying part of the lugs may alternatively be of thickness that tapers from full thickness to some fraction of full thickness.

Sometimes the partial-thickness lugs 218 may not completely fill out the mold pockets 38 as desired. This lug-forming deficiency results from excess cooling and premature freezing of molten metal on the way into the relatively long, thin mold pocket 38. However, this problem of premature freezing is readily corrected by application of thermally sprayed insulative material to the molding surfaces of the mold pocket 38. For instance, zirconia may be applied, as described for plain edge dams in U.S. Pat. No. 4,545,423 of Patek et al. To improve the durability of such coatings, the thermally sprayed material may consist partially of a metal such as nickel. The resulting coating is a reticulum or matrix structure as described in U.S. Pat. No. 4,588,021 of Bergeron et al. Both of these patents are assigned to the same assignee as the present invention. Another way to assist the filling out of the mold pockets 38 for the lugs 218 during casting is to invert the edge dam chain 30 relative to what has been illustrated, so that the mold pockets 38 are adjacent to the bottom of the moving edge dams 30 along the moving mold M. In this way, the mold pockets are fed by molten metal which has flowed under metallostatic pressure over a over or less insulated lower steel casting belt 24 with the result that the molten metal arrives in the lug pockets 38 hotter than it would when the pockets 38 are in their heretofore-described usual position on top of the edge dam 30 along the moving mold M.

The purpose of the above-described methods and apparatus for casting anodes between metallic belts is to cast the lugs as sideways projections from a continuously cast slab of otherwise uniform, smooth width. But it is also possible to process smooth-edged slab of uniform width into anodes having integral lugs. Such a pattern of anode cutting 250 is shown by the cutting lines 251 and 252 in FIG. 8. This cutting pattern 250, 251 and 252 This scheme is the subject of U.S. Pat. No. 3,776,017 of H. Ikeda and M. Yoneda, assigned to Onahama Seiren Kabushiki Kaisha, Tokyo-to, Japan.

However, an improvement over this pattern 250 is shown in the anode pattern 260, suggested by the dotted line 260' in FIG. 8. In electrolytic dissolving tanks, where the anodes are suspended vertically by their lugs, this shape 260 will be more fully and efficiently consumed than that of the anodes 250 in FIG. 8, since the area 262 which is omitted in the improved shape 260 of FIG. 9 is above the surface of the electrolyte. This omission of the casting area 262 is accomplished by using wide edge dam blocks 264 and tapered transition edge dam blocks 265 and 266, as shown in FIGS. 9 and 10A, 10B and 10C. These wide dam blocks 264 plus the tapered edge dam blocks 265, 266 in their assembled relationship define elongated, inwardly projecting lobes 268 on the edge dams 30A for excluding molten metal from the area 262 (FIG. 8), for thereby advantageously reducing scrap in the tankhouse. This improved anode casting method 260, 262, 268 entails that the desired cast-in intrusions 268 occur alternately between one side and the other of the moving mold M, rather than occurring symmetrically and squarely opposite to each other. As in the case of casting of anodes with cast-in lugs 54 or 218, experiments have shown that deliberate, continuously monitored synchronization of these novel shaped or contoured edge dams 30A (FIG. 9) is absolutely necessary.

Figure 9A:
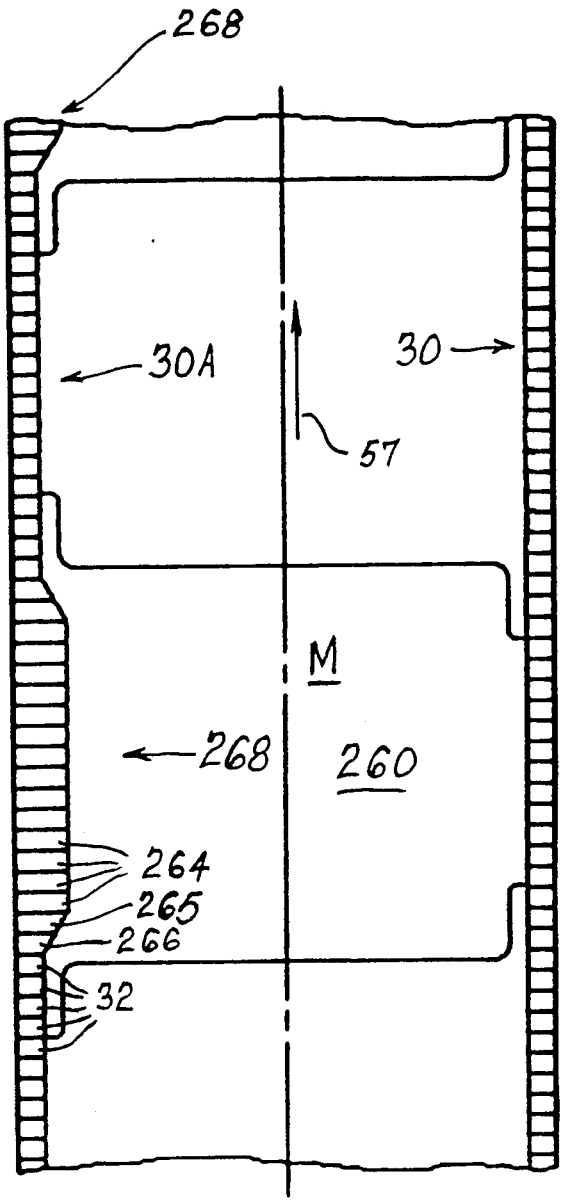
FIG. 9A varies from FIG. 9 in that one edge dam presents a straight, unvaryng surface to the cast product, such that the hollowed shape appears only in every second anode.

FIG. 9A shows a compromise in that one of the edge-dams 30 has no lobes and is straight on its mold side. The other edge dam 30A has the elongated lobes 268. The result is that only every other anode has the desired omission of casting area 262 (FIG. 8). Only half of the benefit--half of the reduced scrap--is obtained, but this use of two different edge dams 30 and 30A is easier to retrofit, since it requires no synchronization of the edge dams 30 and 30A. However, this use of two different edge dams 30 and 30A can benefit from the adjustment or control of tensioning of the cable or strap member 34 that is advantageously provided by the presently described load cell sensing mechanisms 214 or 214A.

The material of the edge dam blocks is typically Corson bronze, though a predominantly cobalt alloy such as X-45 affords remarkably long life, notably when casting copper.

The inverted "back-breaking" apparatus 201A of FIGS. 12, 13 and 14 may advantageously be used to increase the reliability of the seal of each moving edge dam 30 against the lower casting belt 24. This enhanced or increased sealing against the lower belt 24, as provided by the guide roller 232 shown in FIGS. 12 and 14, can be important in the case of open-pool pouring without an semi-sealing snout or nozzle, as provided for in the configuration shown in FIG. 12.

In order to obtain this inverted back-breaker action 201A, the crescent frame 240 with its rollers 62 is raised higher than in the prior art, thereby raising the crest of the edge dams 30 slightly above the plane of the lower casting belt 24 in the moving mold M. The crest of the edge dams 30 is the local region 280 in FIG. 12 where the edge dam leaves the last one of the regular edge dam guide rollers 62 near the pivot shaft 243. The downward-thrusting pinching roller 232 is positioned near to the entrance E of the moving mold M. This pinching roller 232 is in the vertical longitudinal plane of the whole moving edge dam loop 30, but it is located outside of the loop, in such a position as to force the moving edge dam down against the lower casting belt 24 at a region 246 (FIG. 12) downstream from the pinching roller 232. (Downstream is the direction of metal flow.) By generating such a reverse or inverted "back-breaking" bend B in FIG. 14, the seal of the edge dam against the lower belt in the region 246 is rendered more reliable. Moreover, the force of the edge dam blocks locally against each other along the unifying dam strap 34 along the moving mold H is thereby rendered more consistent than occurs solely with the more remote apparatus 201 (FIG. 2) because of the relative absence of binding of blocks, which now do not need to push one another over long distances to slide slightly along the strap 34 in order to close gaps.

In other words, the reverse or inverted back-breaker apparatus 201A of FIGS. 12, 13 and 14 is located near the entrance E to the moving mold M. The bend B (FIG. 14) is located near the entrance E to the moving mold M. The bend B (FIG. 14) consequently provides localized and nearby force for sliding blocks along the strap 34 for closing up any gaps so that the blocks are all snugly against each other as they enter the entrance E as shown in FIG. 12. On the other hand, the back-breaker apparatus 201 (FIG. 2) is remote from the entrance E, and its induced force must therefore cause numerous blocks to push one another to slide along the strap 34 to close up gaps near the mold entrance. The result of this reverse or inverted back-breaker 201A is that the flashing of freezing metal between adjacent blocks 32 etc. is forestalled. This inverted back-breaker 201A may be called the levered dam seal. This resulting sealing pressure in the region 246 is especially important in the pouring of steel, in which the oxide is molten at the melting temperature of the steel, resulting in the water-like flow characteristics of steel, which necessitate unusually thorough sealing of the mold in the region 246.

The just-described reverse or inverted back-breaker apparatus 201A provides an especially favorable location for the load cell assembly 214A, as previously discussed.

Although specific presently preferred embodiments of the invention have been disclosed herein in detail, it is to be understood that these examples have been described for purposes of illustration. This disclosure is not to be construed as limiting the scope of the invention, since the described methods and apparatus may be changed in details by those skilled in the art, in order to adapt these apparatus and methods of casting metal shapes to be useful in particular casting machines or situations, without departing from the scope of the following claims.

We claim:

1. The improved method of synchronizing the motion and position of the edge dams of a continuous metal casting machine in which integral, recurring contoured shapes, which may include projections, lobes, profiles, depressions, cavities and identations, are continuously cast into opposite, generally parallel edges of said product being cast, which method utilizes a twin-belt casting machine wherein a pair of moving edge dams comprising many blocks strung upon opposed parallel flexible unifying closed loops of high strength material travel along the opposed parallel edges of a casting region from its entrance to its outputs end between a pair of revolving casting belts to define a moving mold, wherein said casting belts travel downstream in the machine for carrying molten metal downstream from said entrance to become solidified and wherein said edge dams each include a plurality of identically recurring contoured shapes, which may include depressions, cavities, indentations, projections, and lobes, in order advantageously to shape the aforesaid integral, identically recurring contoured shapes being continuously cast, the method comprising:

sensing the relative progress through said casting region of said continuously cast contoured shapes in said opposed pair of edge dams, by comparison between said edge dams, deriving a control parameter when the error in the position of said depressions or cavities between the two said edge dams departs from a range of pre-established limits, adjustably imposing a roller tensing device against the sagging return reach of at least one of said moving edge dams, which roller tensing device contains a plurality of rollers which exert rolling contact against said moving edge dam, adjusting, with respect to a section of at least one of said moving edge dams, the elevation of at least one aforesaid roller tensing device in response to said control parameter, thereby resulting in synchronizing the progressive movement and position of said pair of edge dams in relation to each other, with the final result that the aforesaid integral repetitive projections or lobes of the aforesaid metal being continuously cast will be disposed in a predetermined, consistently repetitive relationship with respect to each other.

2. The method as set forth in claim 1, with the further step of shaping the aforesaid plurality of repetitive shapes incorproated into the casting side of said edge dam loops to consist of laterally extending depressions or pockets for casting integral, sideways-extending lugs in copper anodes for refining in electrolytic tanks, with the further step of maintaining said depressions or pockets in a symmetrical, diametrally squarely opposed parallel relationship to each other between said edge dam loops, with the result that symmetrically placed supporting lugs are cast into the product as a means of suspending said anodes in electrolytic dissolving tanks.

3. The method as set forth in claim 2, with the further intermediate step of further shaping said laterally extending depressions or pockets for simultaneous continuous casting of integral, sideways-extending lugs in copper anodes such that the inner part of a said lug will be cast at full thickness while the outlying part will be cast at some fraction of said full thickness.

4. The method as set forth in claim 2, with the further intermediate step of further shaping said laterally extending depressions or pockets for simultaneous continuous casting integral, sideways-extending lugs in copper anodes in such a way that the inner part of a said lug will be cast at full thickness, with the outlying part tapering to a lesser thickness.

5. The method as set forth in claim 1 with the further step of rendering automatic said adjustment of approach or retreat of at least one said roller tensing device, in response to changes in said control parameter.

6. The method as set forth in claim 1, including the further steps of monitoring the temperatures of said pair of edge dam loops, adjusting the difference in temperature of said dam blocks between the two said edge dam loops, thereby adjusting the relative length of said blocks and hence the length of each of said edge dam loops differentially with respect to each other in response to said control parameter, thereby aiding the controlled synchronization of the continuous casting of the aforesaid repetitive shapes.

7. The method as set forth in claim 6, in which:

said adjustment of said temperature is that of heating.

8. The method as set forth in claim 6, in which:

said adjustment of said temperature is that of cooling.

9. The method as set forth in claim 6, in which:

said adjustment of said temperature is that of heating either one of said edge dams and cooling the other.

10. The method as set forth in claim 6, in which:

said adjustment of said temperature is that of heating and cooling serially at least one of said edge dams.

11. The method as set forth in claim 6, including the further edge of rendering automatic said temperature adjustment of said blocks of the edge dams, in response to said control parameter.

12. The method as set forth in claim 11, in which:

said adjustment of said temperature is that of heating.

13. The method as set forth in claim 11, in which:

said adjustment of said temperature is that of cooling.

14. The method as set forth in claim 11, in which:

said adjustment of said temperature is that of heating either one of said edge dams and cooling the other.

15. The method as set forth in claim 11, in which:

said adjustment of said temperature is that of heating and cooling serially at least one of the edge dams.

16. The method as set forth in claim 1, in combination with the additional method of guiding a said edge dam loop against at least one said guide roller which cooperates with an electrical load-measuring device to measure the force of the edge dam loop against said guide roller, specifying the optimum range of force which said roller guide is to exert aginst said edge dam loop, and avoiding in so doing (1) the lower extreme of allowing the tension within said closed flexible unifying loops of the edge dams to fall so low as to allow the opening of gaps betwen said blocks of the edge dam loop while avoiding also (2) the upper extreme of causing breakage or needless wear, deriving a control parameter by comparing said force so measured with said determined optimum range of force, controlling within upper and lower limits said force by adjusting when necessary, the advance or retreat of said roller tensing device with respect to said edge dam loop, in response to said control parameter.

17. The method as set forth in claim 16, in which said load-measuring device is installed in proximity to the return reach of a said edge dam loop.

18. The method as set forth in claim 16, in which said load-measuring device is installed in proximity to the entrance to the aforesaid mold.

19. The method as set forth in claim 1, with the additional step of providing, in connection with at least one moving edge dam loop at the upstream or entrance end of the lower carriage of said twin-belt casting machine, a first, essentially fixed edge dam guide roller disposed near the mold entrance and intruding above the pass line, said roller being situated within said moving edge dam loop, together with the additional step of providing a second edge dam guide roller against the outside of said moving edge dam loop in the zone downstream from said first guide roller and upstream from the mold region of said casting machine, in such wise as to force said moving edge dam loop downward against the lower casting belt at the mold entrance at a point downstream from said second guide roller, with the additional result that the entrance to the mold at the lower edge of said edge dam blocks is effectively sealed against the outward leakage of molten metal.

20. The method as claimed in claim 19 including the step of:

sensing the downward-thrusting of said downward-thrusting second roller.

* * * * *